United States Patent [19]

Spanel et al.

[11] 4,119,047

[45] Oct. 10, 1978

[54] CUTTER MECHANISM FOR TUFTING MACHINE OR THE LIKE

[75] Inventors: Abram N. Spanel, 344 Stocton St., Princeton, N.J. 08540; P. Frank Eiland, Stamford; David R. Jacobs, New Canaan, both of Conn.; David N. Buell, Littleton, Colo.

[73] Assignee: Abram N. Spanl, Princeton, N.J.

[21] Appl. No.: 811,969

[22] Filed: Jun. 30, 1977

[51] Int. Cl.[2] ..... D05C 15/16

[52] U.S. Cl. ..... 112/79 FF; 112/294; 112/297; 83/542; 83/580; 83/582

[58] Field of Search ..... 112/79 R, 79 A, 294, 112/297, 288, 285, 130; 83/542, 580, 582

[56] References Cited

U.S. PATENT DOCUMENTS

| | | | |
|---|---|---|---|
| Re. 27,165 | 8/1975 | Spanel et al. | 112/79 R |
| 380,618 | 4/1888 | Clark | 83/580 |
| 2,874,776 | 2/1959 | Hooe | 83/542 X |
| 3,545,327 | 12/1970 | Dorman | 83/542 |
| 3,937,157 | 2/1976 | Spanel et al. | 112/79 FF |

*Primary Examiner*—H. Hampton Hunter
*Attorney, Agent, or Firm*—J. Rodman Steele, Jr.

[57] ABSTRACT

A cutter mechanism for use in a tufting machine or the like featuring a stationary blade having openings through which yarn strands project, the stationary blade being positioned in the path of travel of yarn strands from yarn creels to bit-applying elements with the cutter mechanism further featuring a series of reciprocable blades which are biased against the stationary blade whereupon reciprocation the reciprocable blades will pass over the openings and because of their biasing effect, penetrate the plane of the stationary blade passing into the openings thereby severing the yarn strands.

15 Claims, 12 Drawing Figures

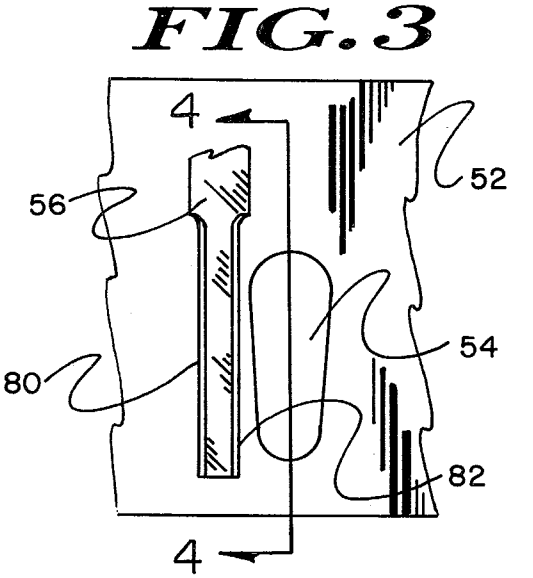
FIG. 3
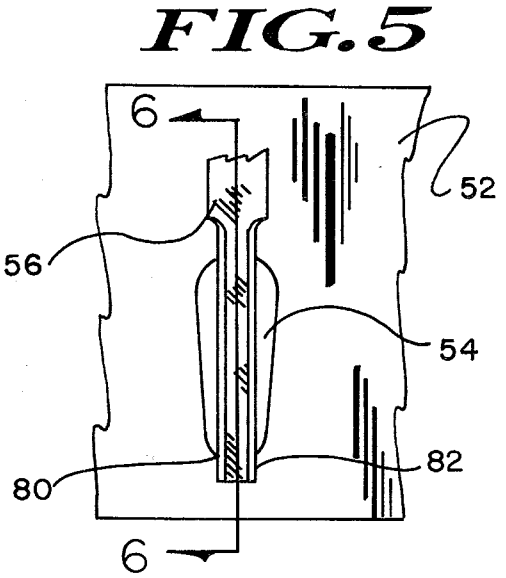
FIG. 5
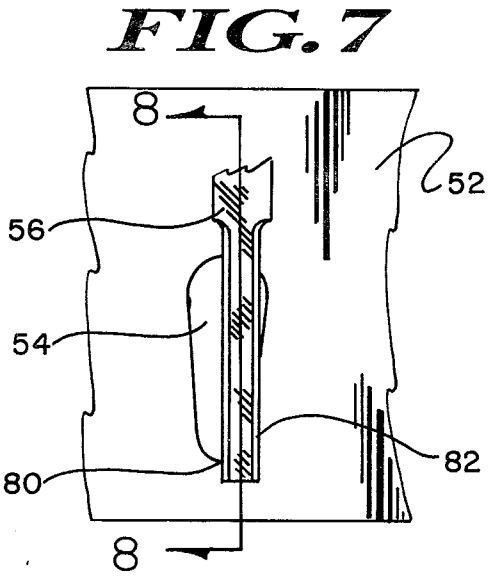
FIG. 7
FIG. 4
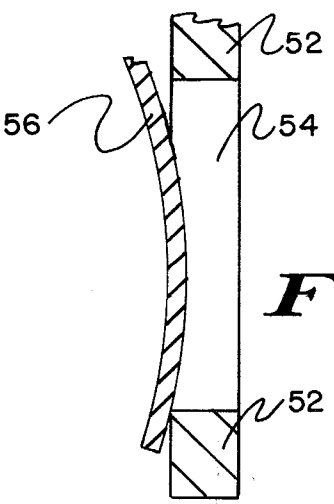
FIG. 6
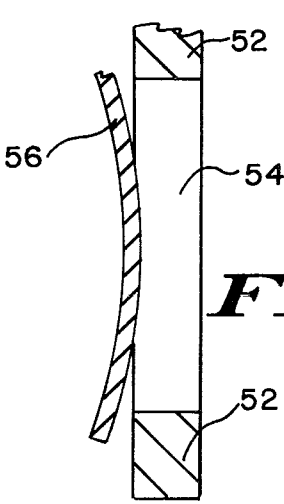
FIG. 8

CUTTER MECHANISM FOR TUFTING MACHINE OR THE LIKE

BACKGROUND OF THE INVENTION

The subject application discloses a cutter mechanism which has utility in textile operations where yarn is to be severed. The mechanism has particular utility in tufting techniques which have become known as the "Spanel tufting system". Generally, this system utilizes pneumatic means to transport yarn to a tufting station (either in metered lengths of an unsevered yarn strand or in discrete bits), after which the yarn is tufted into a backing layer to form a tufted product. Needles may either be utilized for the tufting or alternatively the yarn bits may be adhesively applied to the backing layer by stomper-type means.

The present invention discloses improvements to the embodiments of early Spanel patents particularly U.S. Pat. No. 3,554,147 which issued to Abram N. Spanel and George J. Brennan on Jan. 12, 1971 and U.S. Pat. No. Re 27,165 which issued Aug. 10, 1971 to Abram N. Spanel and Loy E. Barton.

The aforementioned U.S. Pat. No. Re 27,165 discloses a pneumatic yarn transport system in which yarn is transported pneumatically to a tufting station where it is applied by tufting elements to a backing layer. Multicolor selection of the yarn bits is enabled by a shifting magazine which provides yarn of various colors to each of a series of guide tubes through which yarn is transported to the tufting elements. The yarn is cut in aforementioned U.S. Pat. No. Re. 27,165 by moving knife blade 15 which extend between the magazine and the guide tubes. Once cut, the bits of yarn are transported pneumatically to a corresponding tufting station where they are applied to the backing layer.

The aforementioned U.S. Pat. No. 3,554,157 describes an alternative system and provides for the simultaneous selection of bit lengths of yarn by means of a collator structure in which individual channels transport yarn into a common passageway adjacent the tufting station.

BRIEF SUMMARY OF THE INVENTION

In accordance with the subject invention, the Spanel apparatus disclosed herein comprises a cutting mechanism which is especially adapted for the general type of Spanel multi-color pneumatic tufting machines disclosed in aforementioned U.S. Pat. Nos. 3,554,147 and U.S. Pat. No. Re 27,165. Yarn strands of different colors are selectably metered by a selection and metering system and pneumatically transported to the tufting station. It is preferred that the cutter mechanism be positioned adjacent the tufting station to sever a bit length of yarn from the yarn strand which has been transported to each of a multiplicity of needle stations. Each machine may have as many as 1200 needle stations and multi-color selection for each needle may be provided.

The cutter mechanism which will be essentially the same regardless of where in the system it is positioned comprises a stationary knife or blade having openings which correspond to each channel through which yarn is fed to each of the tufting stations. Reciprocating knives or blades move back and forth across each of the openings severing yarn which projects through the openings. The reciprocating or travelling knives are biased against the stationary blade so that as each reciprocating blade passes over an opening, there is a bowing action as the reciprocating blade extends into the plane of the stationary blade within the opening. This permits a non-dulling cutting action which results in superb shearing. Both stationary and reciprocating blades preferably have cutting edges to facilitate the yarn severance.

Each of the individual reciprocating blades comprise cutting edges on each side so that cutting with a corresponding opening may take place regardless of whether the reciprocating blades are moving to the left or right. It is contemplated that all of the reciprocating blades for the entire machine will be moved in unison either to the right or left once the yarn strands have been loaded and are projecting through the openings of the stationary blades. The blades must not block the stationary blade openings during the loading step so that yarn is free to pass through the openings. Each of the reciprocating blades may comprise an individual unit which is mounted to a reciprocating carrier bar positioned above the yarn channels and the stationary blade.

BRIEF DESCRIPTION OF THE DRAWINGS

For a more detailed understanding of the invention, reference is made in the following description to the accompanying drawings in which:

FIG. 3 is the first of a series of front sequential views showing the reciprocating blade preparatory to moving to the right across the opening of the stationary blade.

FIG. 4 is a cross-section view taken along lines 4—4 showing the reciprocating blade and stationary blade in their positions as shown in FIG. 3.

FIG. 5 is the second of the series of sequential front views showing the reciprocating blade passing across the opening of the stationary blade.

FIG. 6 is a cross-sectional view taken along lines 6—6 showing the elements as positioned in FIG. 5 with the reciprocating blade bowing into the opening of the stationary blade.

FIG. 7 is the third and final figure of the series of sequential front views showing the reciprocating blade as it completes its movement across the opening of the stationary blade.

FIG. 8 is a cross-sectional view taken along lines 8—8 showing the elements as positioned in FIG. 7 with the reciprocating blade completing its passage across the opening.

DETAILED DESCRIPTION

Figure 1:
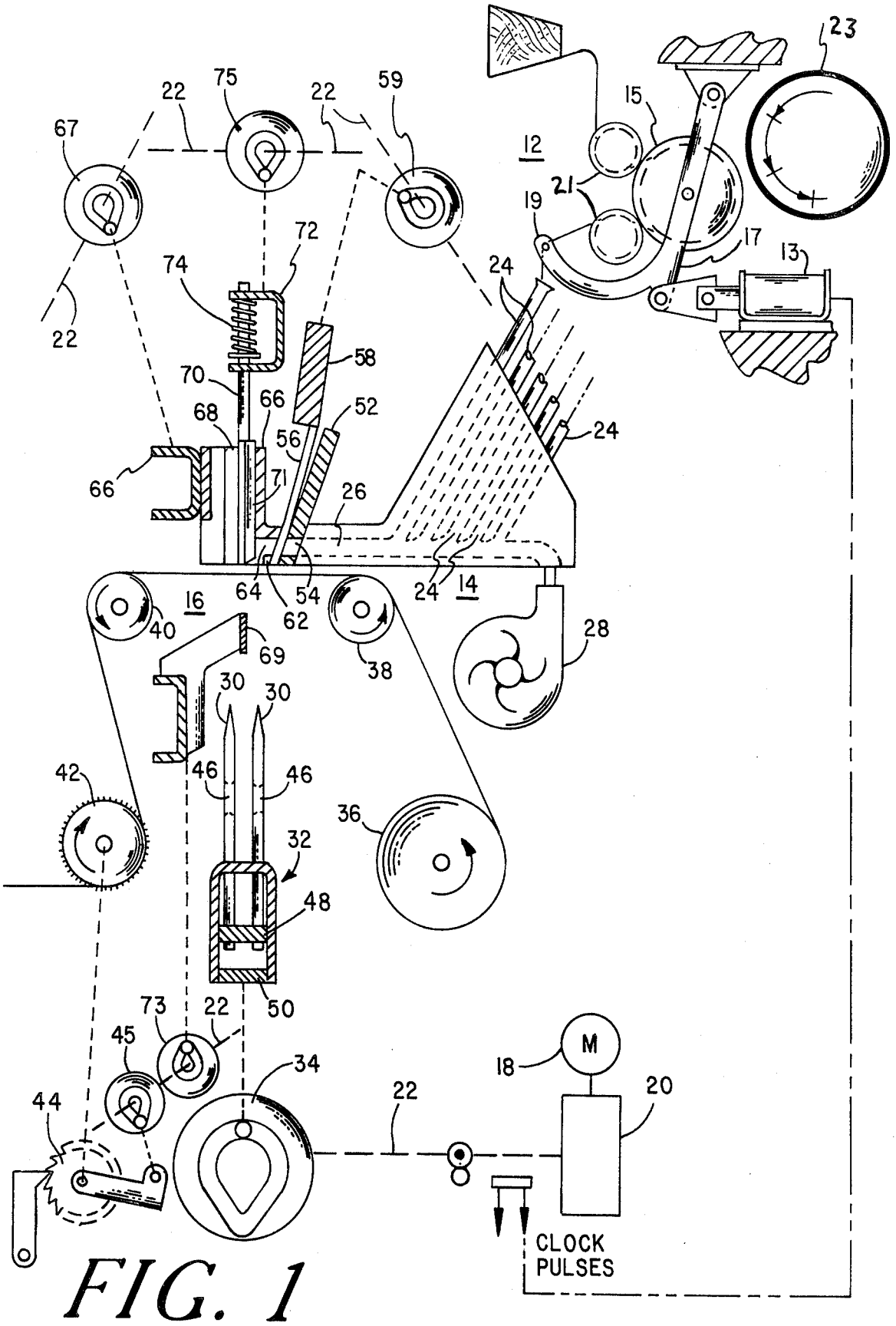
FIG. 1 discloses a schematic view of one embodiment of the tufting apparatus in which the subject cutting mechanism may be utilized.

With reference to FIG. 1, tufting apparatus as disclosed herein includes yarn selection and metering apparatus 12, pneumatic transport apparatus 14, and a tufting station 16. Each tufting station 16 is representative of as many as 1200 such tufting stations and for each tufting station there will be available some five or eight yarn strands each representing a different color or some other variable.

Control signals for operation of each selection actuation means for each selection and metering apparatus may be provided by any of various readout devices. To produce a desired pattern on a backing layer, pattern information recorded on tapes, drums or other medium is converted into electrical or other types of signals which, at the proper time with regard to the machine tufting cycle, as indicated by the dashed clock pulses of FIG. 1, are transmitted to the actuation means 13 for the yarn selection and metering apparatus. The selection actuator 13 may be a solenoid or it may be any suitable one of a variety of electrical, thermal, pneumatic or hydraulic, etc. type actuators. For details of selection and metering in the Spanel tufting system aforementioned U.S. Pat. No. 3,554,147 and U.S. Pat. No. Re 27,165 should be consulted as well as U.S. Pat. No. 3,937,157 of which Abram N. Spanel and David R. Jacobs are inventors and co-pending application Ser. No. 699,904. a rotatable yarn feed mechanism 15 which may be on the order of that disclosed in U.S. Pat. No. 3,937,157 is shown in FIG. 1 together with intermediate linkage means 17 which extends from actuator 13 to rotatable yarn feed mechanism 15 and which also controls the yarn pull-back mechanism 19 fully described in U.S. Pat. No. 3,937,157. The yarn feed mechanism also includes yarn guides 21 and drive roll 23. The selection and metering system including yarn pull-back means of co-pending application Ser. No. 699,904 may be used as well as the rotatable yarn feed mechanism.

A motor 18 is shown driving the machine by means of drive transmission 20 which may be a train of gears or comprise other mechanisms. A shaft 22 is schematically shown running throughout the device from which drive mechanisms operate as will be described subsequently.

Briefly, specific color selection signals are generated in response to the color requirements of a desired pattern, and for each of the color selection signals transmitted to a selection actuation means 13, a predetermined length of selected yarn is metered by yarn selection and metering apparatus 12 and advanced by pneumatic transport apparatus 14 through yarn guide tubes 24 so that the selected yarn strand extends into a common passageway 26 leading to tufting station 16 where it will be cut and the resultant yarn bit tufted into backing layer L. A pneumatic source 28 schematically shown provides the pneumatic supply for pneumatic transport apparatus 14. Reference may once again be made to U.S. Pat. No. 3,937,157 or co-pending application Ser. No. 699,904 for suitable pneumatic systems. The pull back mechanism 19 which is part of the yarn selection and metering apparatus 12 will remove the last-selected yarn strand from the common passageway 26 adjacent the tufting station after severance of the yarn bit, preparatory to the next color selection by the control signals.

At the tufting station, tufting needles 30 with aligned eyes receive the yarn strands preparatory to tufting. The needles 30 are mounted on a needle bar 32 which via cam drive 34 provides reciprocable motion to the needles 30.

The backing L may be fed from a supply roll 36 over roller member 38. Idler roll 40 directs the tufted product to the take-up pin roll 42 which operates from the ratchet and pawl mechanism 44 functioning off cam drive 45.

Figure 2:
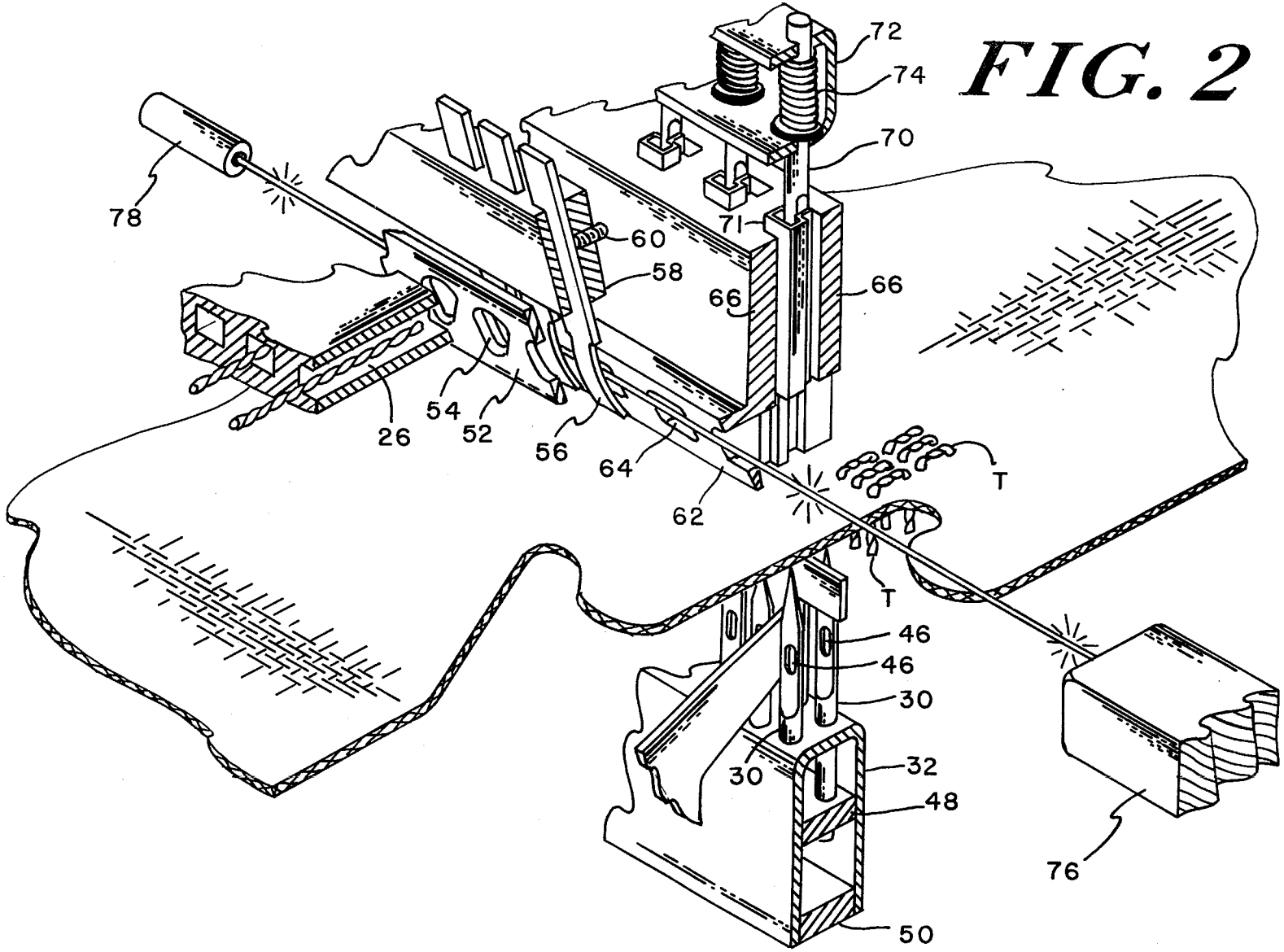
FIG. 2 is a perspective view showing a tufting station together with the cutter mechanism.

With reference to FIG. 1 and FIG. 2, the tufting station 16 is shown comprising needles 30 which have aligned eyes 46. Each individual tufting station comprises dual needles 30 on the order of those disclosed in aforementioned Reissue Patent Re. 27,165. A needle bar 32 of lightweight construction aligns the needles 30 which are secured within the needle bar by needle bar insert member 48. A needle bar base plate 50 serves as mounting means for standard linkage structure which will drive the needle bar 32 by cam drive 34.

With further reference to FIGS. 1 and 2, a cutter mechanism stationary blade 52 having openings 54 is positioned adjacent common passageway 26 through which yarn extends toward each tufting station 16. Immediately adjacent the stationary blade 52, reciprocating blades 56 are positioned which are secured to reciprocating blade holder 58 which reciprocates in a widthwise direction with respect to the machine. This reciprocation is shown schematically as being provided by cam 59 in FIG. 1. Each individual reciprocating blade 56 is secured to reciprocating blade holder 58 by a locking and adjustment means 60 which may be on the order of a set screw device.

Adjacent the reciprocating blades, yarn adjuster 62 is shown having yarn openings 64 which align with the openings 54 of the stationary blade 52 to enable yarn strands to be pneumatically fed through to the tufting needles 30. The yarn adjustor 62 provides the tufting apparatus with the capability of selecting and tufting yarn of different lengths to produce rugs of different pile heights either on the same or different rugs. With reference to FIG. 2, U-shaped tufts are disclosed and it can be appreciated from FIGS. 1 and 2 that if different yarn lengths are metered by the yarn selection and metering apparatus 12 in the absence of some adjustment means, unequal tufts will result which will be of the nature of J-shaped rather than U-shaped since more or less yarn will be fed to the right of the needles 30 than the amount of yarn to the left of the needles 30 between the needles 30 and the cutting mechanism. Thus in constructing the apparatus disclosed herein, it is preferred to have the distance between the needles 30 and the reciprocating blade 56 be equal to the shortest tuft-leg length that will be produced on the machine. If longer tufts are desired, the additional necessary yarn is advanced by the metering means 12 and pneumatically fed to the needles 30 with the additional yarn being fed to the right of the needles 30. The yarn adjuster 62 will then rise lifting the yarn and pulling back one half of the additional yarn to the left of the needles prior to severance by the reciprocating blade 56 so that each tuft-leg will be equal and U-shaped tufts will result. It will be appreciated that the above designations of right and left of the needles were directed to the view as shown in FIG. 2. The terms should be reversed when viewing FIG. 1.

Yarn adjuster carrier bar 66 is shown being an integral part of the yarn adjuster 62 and vertical reciprocation of the yarn adjuster carrier bar 66 is enabled through linkage by eccentric member 67 schematically shown in FIG. 1.

Yarn bit clamps 70 are shown which clamp the yarn against the backing layer L prior to tufting by the needles 30 and before, during or after severance of the yarn. A shiftable support member 69 is provided opposite the backing layer L from the clamps 70 to provide support for the backing layer. The support member 69 is controlled by cam member 73 and is cleared from its support position as the backing layer L is advanced.

The yarn bit clamp 70 is shown having hollow shields 71 into which extend the needle 30 of each needle pair which is closest to the yarn adjuster 62. The shield serves to prevent impalement of the yarn by the shielded needle 30 as it descends in close proximity to the yarn adjuster 62.

The yarn adjuster carrier bar 66 is shown having channels 68 through which the bit clamps 70 are permitted to reciprocate as does yarn adjuster carrier bar 66 although independent of each other. The bit clamps 70 are secured to bit clamp carrier bar 72 which is shown housing spring means 74 supported by flange support 148 for each of the individual bit clamps 70. As shown in FIG. 1, cam 75 provides the vertical reciprocation for carrier bar 72.

A laser 76 is shown which will be positioned on one extreme side of the machine while a photo detector 78 will be positioned at the opposite side of the laser aligned therewith so that the laser beam may be used to detect the presence of yarn in any of the channels at a time when such yarn should not be present. The presence of yarn at such a time indicates a malfunction.

With reference now to FIG. 3, a portion of stationary blade 52 is shown in which one opening 54 is also shown. One of the reciprocating blades 56 is shown having left and right cutting edges 80 and 82 respectively. With the reciprocating blade 56 in the position shown in FIG. 3, yarn may be pneumatically transported to the tufting station with a selected yarn strand fed so as to project through opening 54 of stationary blade 52.

As can be seen in FIG. 4, the reciprocating blade 56 is biased against the stationary blade 52. The blade surface 56 is flush against the surface of 52 from a position below the upper edge of the opening 54 down to the lower extremity of the knife 56 below opening 54. The biasing of the reciprocating blade 56 can be seen to begin below the top of opening 54 which ensures proper bowing of the blade. For this reason, reciprocating blade 56 does not have to be supported bv stationary blade 52 at all in the area above opening 54. As an alternative, opening 54 may also be a U-shaped slot opening to the top, the slot being wider at its top than at its bottom.

With reference to FIG. 5, the reciprocating blade 56 is shown moving across opening 54 of stationary blade 52 during the cutting motion.

With reference to FIG. 6, the bowing action of blade 56 can clearly be seen as reciprocating blade 56 passes across the center of opening 54. The blade 56 penetrates into the opening 54 through the plane of the stationary blade 52.

With reference to FIG. 7, the reciprocating blade 56 is shown passing to the end of opening 54 where cutting action will normally be taking place in the opening. As shown in FIG. 8, the blade 56 is still penetrating the plane of the blade 52 in the upper portion of opening 54 as the lower part of the blade 56 engaged the edge of opening 54 as it "climbs out" of the opening incrementally up the edge of the opening. It is this movement that enables superb sheering action with a non-dulling effect.

Figure 9:
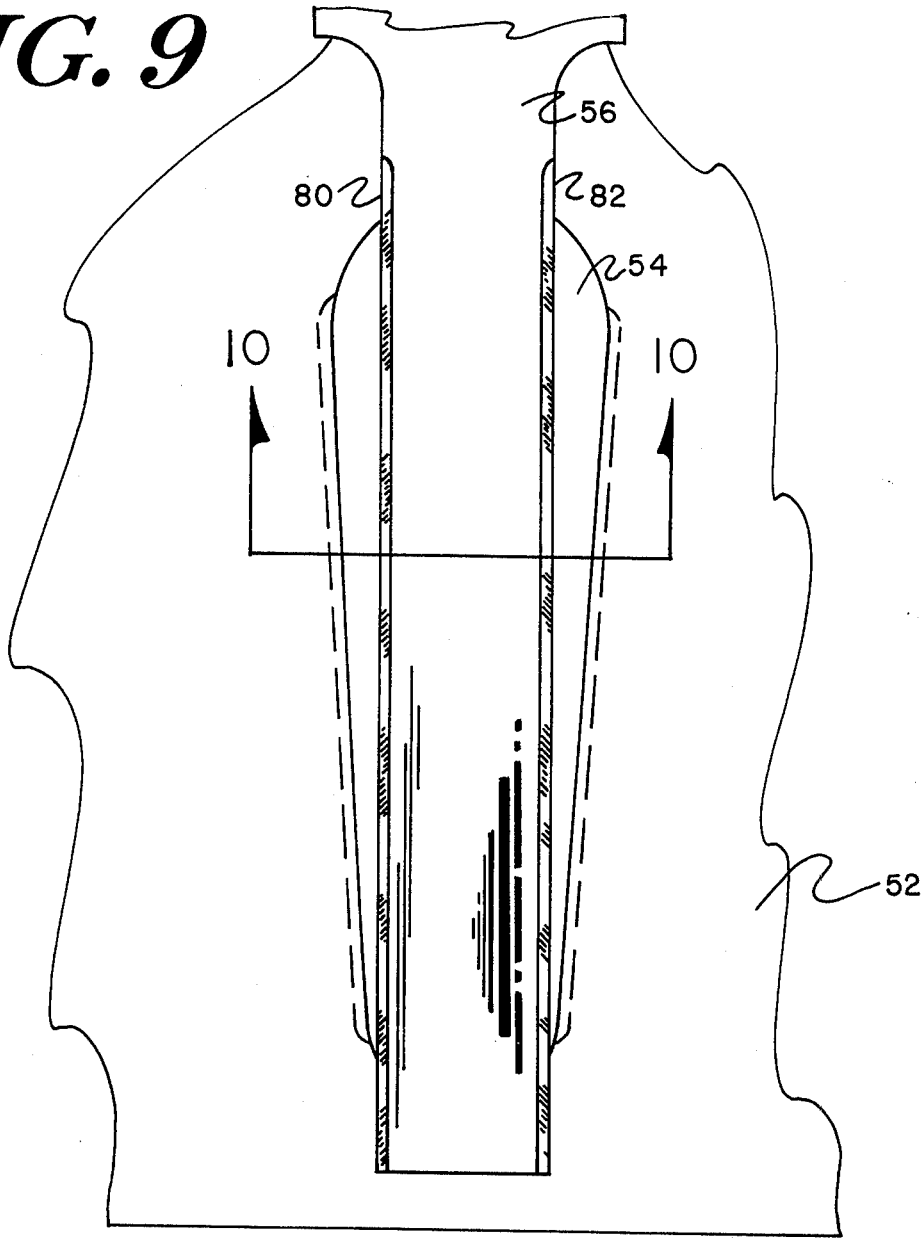
FIG. 9 is an enlarged view showing in particular the rake on a reciprocating blade.
Figure 10:
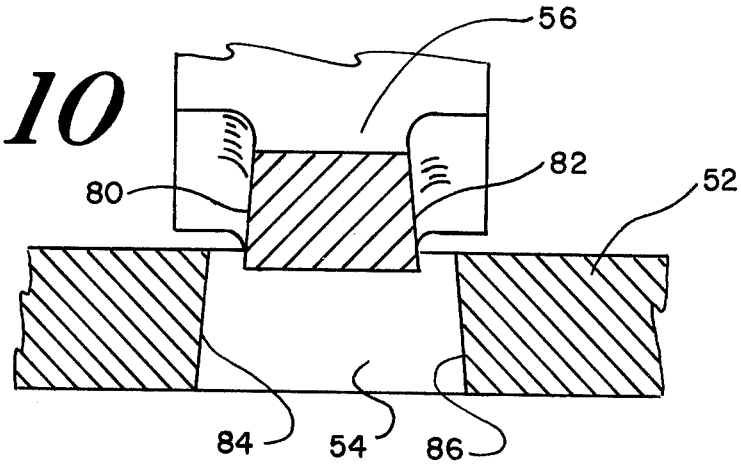
FIG. 10 is a cross-sectional view taken along the lines 10—10 of FIG. 9.

As shown in FIGS. 9 and 10 which are greatly enlarged views, the reciprocating blade 56 has cutting edges 80 and 82 which each have a cutting angle of approximately 87°. The stationary blade 52 has cutting edges 84 and 86 which also each have a cutting angle of approximately 87°. The opening 54 is shown as being elongated with curvilinear top and bottom, with curvilinear top having a greater radius than curvilinear bottom, a design which enhances excellent cutting results.

Figure 11:
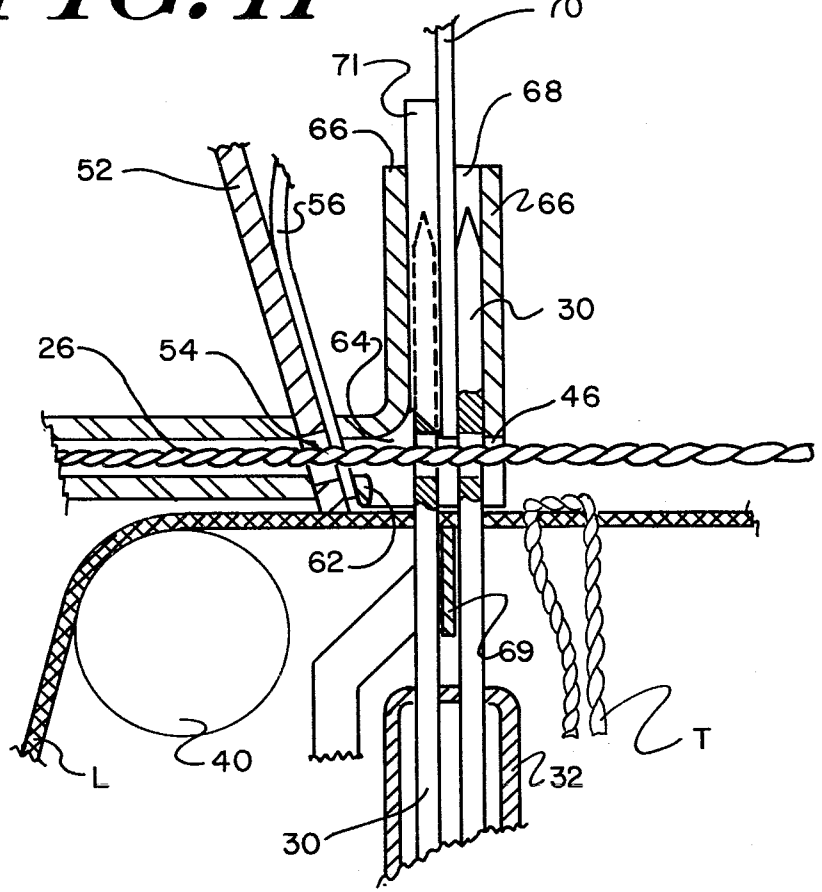
FIG. 11 is a cross-sectional side view of a tufting station of FIG. 2 showing a loaded yarn strand prior to severance.

With reference to FIG. 11, a yarn strand is shown extending through common passageway 26 to the tufting station 16 where it is loaded in needles 30. The strand passes through opening 54 of the stationary blade 52, opening 64 of the yarn adjuster 62 into the aligned needle eyes 46. If U-shaped tufts are desired and equal portions of the yarn strand are on the right and left sides of the needles 30, the step of severing may take place. If yarn to the right of the needles is greater than that to the left, the result of metering a predetermined amount, the yarn adjuster 62 will ascend a predetermined distance to equalize the amount of yarn on each side of the needles as for example is shown in FIG. 12.

Figure 12:
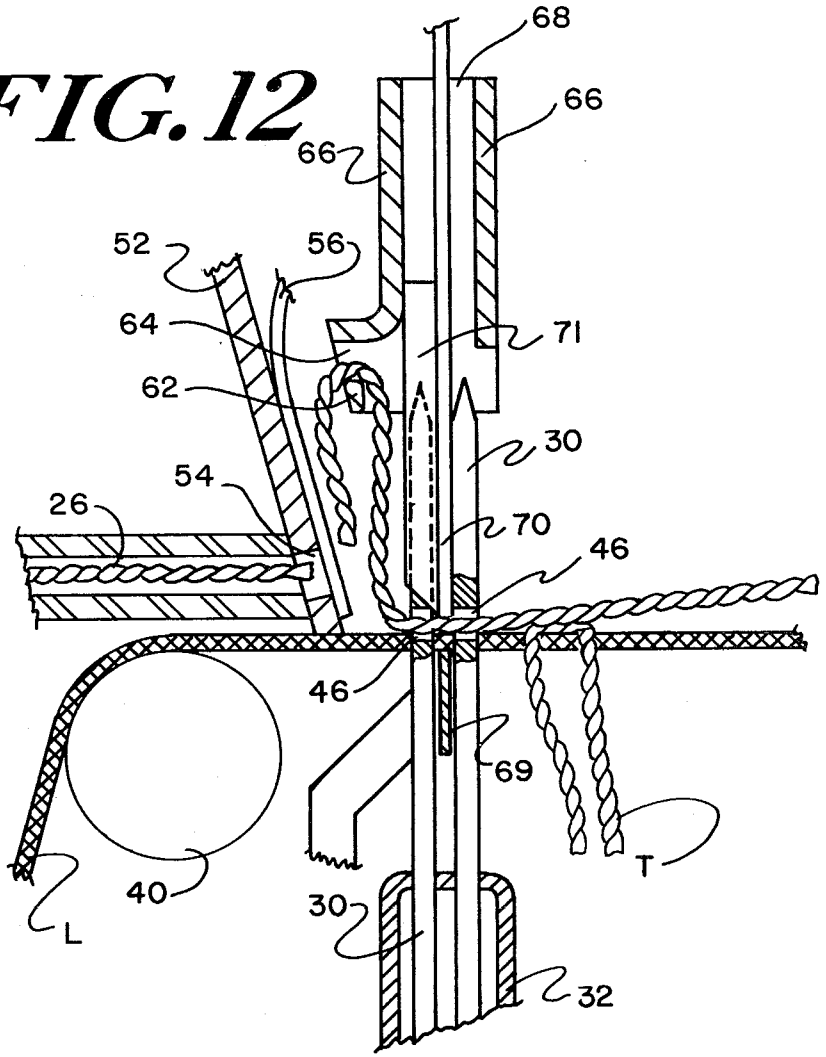
FIG. 12 is a cross-sectional side view of the tufting station of FIG. 11 showing the yarn bit being tufted after severance from the yarn strand.

With further reference to FIG. 12, reciprocating blade 56 has just passed over the opening 54 of the stationary blade 52 severing the yarn into a discrete bit which is loaded in tufting needles 30. The yarn adjuster 62 is in its raised position and has withdrawn yarn from the right so that equal lengths of the yarn bit extend both left and right of the tufting needles 30. The yarn bit clamp 70 is shown clamping the yarn against the backing layer L. The needles are shown beginning to descend to implant the yarn bit into the backing layer L in the manner as the preceding bit length which has been tufted as shown.

As can be seen from FIG. 12, the yarn to the right of the reciprocating blade 56 is raised by the yarn adjuster 62 and this action occurs preparatory to tufting. Accordingly, the yarn strand passes through the upper portion of opening 54 of the stationary blade 52. The cutting therefore often occurs as the reciprocating blade 56 passes through the upper end of the opening 54 as shown in the sequential drawing of FIG. 7. The shearing action of the blade appears to be excellent at this instant and severing reliability is at its best.

With yarn strands being transported to as many as 1200 tufting stations, it is easily understood that excellent shearing action of the cutter mechanism must be achieved or otherwise defective products will result. Additionally, the commercial value of the machine depends upon continuous and unabated operation and reliability of the cutting operation must be higher than any previously designed cutters could achieve. The reciprocating blades 56 appear to exhibit a non-dulling phenomena when operated as disclosed herein.

While not to be construed as limiting, the use of M2 tool steel for stationary blade 52 and high speed tool steel for reciprocating blades 56 represents a good combination. It is desirable to use softer steel for the reciprocating blades 56 since they can be sharpened easier than the stationary blade 52.

While the angle of stationary blade 52 and reciprocating blades 56 is shown to be other than perpendicular to the path of travel of yarn, this design feature does not affect the functionality of the unit and was done only to accommodate other mechanisms within a tight area.

It will be noted from FIG. 9 that the width of reciprocating blade 56 is narrower than much of the width of the opening 54 of stationary blade 52. This enables the bowing action of blade 56 which is important to the superb cutting result.

Co-pending application Ser. Nos. 811,968; 811,970; 811,955; and 811,957, all filed concurrently herewith should be consulted for further description of the laser detector 76, 78, bit clamp 70, 71, yarn adjuster 62, and needle bar 32.

The present invention may be embodied in other specific forms without departing from the spirit or essential attributes thereof, and, accordingly, reference should be made to the appended claims, rather than to the foregoing specification as indicating the scope of the invention.

What is claimed is:

1. In a tufting machine or the like, a cutting mechanism comprising:

a stationary blade having at least one opening therein through which at least one yarn strand projects; and at least one reciprocating blade biased against said stationary blade and positioned so as to travel across said opening with said biasing causing said reciprocating blade to bow through the surface of the plane of said stationary blade facing said reciprocating blade into said opening thereby severing the yarn strand as said reciprocating blade passes across said opening.

2. The tufting machine or the like of claim 1, wherein said reciprocating blade has two cutting edges.

3. The tufting machine or the like of claim 1 further including bit-applying means for applying yarn bits to a backing layer, metering means to provide predetermined lengths of yarn and pneumatic means to transport the yarn to said cutting mechanism for severance to provide a yarn bit for application to a backing layer.

4. The tufting machine or the like of claim 3 wherein said bit-applying means comprises dual needles with aligned eyes and wherein a yarn strand to be severed by said cutting mechanism is loaded in said aligned eyes prior to severance.

5. The tufting machine or the like of claim 4 further including a yarn adjuster positioned between said reciprocating blade and said tufting needles wherein said yarn adjuster raises the yarn strand extending through said opening of said stationary blade preparatory to severance of the yarn strand by said reciprocating blade.

6. The tufting machine or the like of claim 5 further including clamp means which clamps said yarn after said yarn adjuster raises said yarn, said clamping occurring before, during or after the severance.

7. The tufting machine or the like of claim 1 wherein said opening is curvilinear with one end wider than the other.

8. The tufting machine or the like of claim 7 wherein at least one of said ends is curvilinear.

9. The tufting machine or the like of claim 7 wherein said reciprocating blade is narrower than the greatest widthwise dimension of said opening.

10. The tufting machine or the like of claim 1 including a series of said reciprocating blades wherein each of said reciprocating blades is secured to a blade holder extending across said machine which is reciprocable.

11. The tufting machine or the like of claim 10 wherein each of said reciprocating blades is secured to said blade holder by a blade locking and adjustment means.

12. The tufting machine or the like of claim 1 wherein said reciprocating blade is longer than said opening.

13. The tufting machine or the like of claim 12 wherein said reciprocating blade is biased to be flush against said stationary blade for less than the corresponding vertical distance of said opening.

14. In an apparatus or the like for applying yarn bits to a backing layer:

reciprocable bit-applying means movable to and from loading positions on a selected side of the backing layer;

metering means for advancing lengths of yarn;

pneumatic means for transporting said lengths of yarn to said loading positions;

severing means, in close proximity to said bit-applying means for severing bit lengths of yarn from said advanced lengths of yarn, said severing means comprising a stationary blade having openings therein for receiving said lengths of yarn and reciprocating blades biased against said stationary blade and positioned to travel across said openings so as to penetrate the plane of said stationary blade by bowing into said openings thereby severing said lengths of yarn into bit lengths for application to a backing layer.

15. Apparatus including bit-applying means for applying yarn to a backing layer comprising:

a plurality of inlet passageways extending to a common outlet;

a plurality of metering devices, each metering yarn from a different yarn source and communicating with one of said inlet passageways;

means for pneumatically transporting a selected yarn through said common outlet and to a bit-applying station;

strand-severing means to sever said selected yarn preparatory to yarn application, said strand-severing means including a stationary blade having openings for receiving yarn and a series of reciprocating blades biased against said stationary blade and positioned so as to travel across said openings, said biasing causing said reciprocating blades to bow and penetrate said openings thereby severing yarn extending therethrough; and pull back means to remove yarns from said common outlet once a yarn bit has been severed.

* * * * *

UNITED STATES PATENT OFFICE

CERTIFICATE OF CORRECTION

Patent No. 4,119,047 Dated Oct. 10, 1978

Inventor(s) Abram N. Spanel, P. Frank Eiland, David R. Jacobs, and David R. Buell It is certified that error appears in the above-identified patent and that said Letters Patent are hereby corrected as shown below:

Title page, Item [73], delete "Spanl", and insert--Spanel--.

Signed and Sealed this

Sixth Day of March 1979

[SEAL]

*Attest:*

RUTH C. MASON
*Attesting Officer*

DONALD W. BANNER
*Commissioner of Patents and Trademarks*